US005960895A

United States Patent [19]

Chevallier et al.

[11] Patent Number: 5,960,895

[45] Date of Patent: Oct. 5, 1999

[54] APPARATUS FOR PROVIDING A THRUST FORCE TO AN ELONGATE BODY IN A BOREHOLE

[75] Inventors: Sebastien Arnaud Chevallier; Alban Michel Faure; Peter Oosterling, all of GD Rijswijk, Netherlands

[73] Assignee: Shell Oil Company, Houston, Tex.

[21] Appl. No.: 08/606,524

[22] Filed: Feb. 23, 1996

[30] Foreign Application Priority Data

Feb. 23, 1995 [EP] European Pat. Off. ..... 95200459

[51] Int. Cl.[6] ..... E21B 44/00; E21B 4/00; E21B 19/08

[52] U.S. Cl. ..... 175/27; 175/323; 175/325.3

[58] Field of Search ..... 175/325.3, 323, 175/26, 27

[56] References Cited

U.S. PATENT DOCUMENTS

| | | | |
|---|---|---|---|
| 4,190,123 | 2/1980 | Roddy | 175/325.3 |
| 4,365,678 | 12/1982 | Fitch | 175/323 |
| 5,220,963 | 6/1993 | Patton | 175/24 |
| 5,421,420 | 6/1995 | Malone et al. | 175/61 |

FOREIGN PATENT DOCUMENTS

| | | | |
|---|---|---|---|
| 66525 | 10/1914 | Austria | 175/325.3 |
| 0 288 123 | 10/1988 | European Pat. Off. . | |
| WO 9100-410 | 1/1991 | WIPO . | |
| WO 93/24728 | 12/1993 | WIPO . | |

*Primary Examiner*—Hoang C. Dang

[57] ABSTRACT

A downhole tool for providing a thrust force to an elongate body extending in a borehole formed in an earth formation is provided. The tool comprises at least one rotatable body provided with a plurality of rollers, each roller being expandable against the borehole wall at a selected contact force between the roller and the borehole wall. The rollers are oriented when expanded against the borehole wall so as to roll along a helical path on the borehole wall, and a motor is provided to rotate each rotatable body. The tool further comprises a device to measure the thrust force provided by the tool and a control system to control the thrust force provided by the tool by regulating the rotative torque of the rotatable body, in response to the measured thrust force.

15 Claims, 1 Drawing Sheet

APPARATUS FOR PROVIDING A THRUST FORCE TO AN ELONGATE BODY IN A BOREHOLE

BACKGROUND OF THE INVENTION

The present invention relates to a downhole tool for providing a thrust force to an elongate body extending in a borehole formed in an earth formation. Such elongate body can be, for example, in the form of a drilling assembly used to drill the borehole. In conventional drilling operations a compressive load is exerted from surface and transmitted through the drillstring to the drill bit in order to generate sufficient compressive load on the bit, which compressive load is generally referred to as Weight On Bit. When the drilling assembly includes a relatively small diameter tubing which is unreeled at surface and lowered into the borehole as drilling proceeds, which tubing is also referred to as coiled tubing, the amount of compression which can be transmitted by such small diameter tubing is limited due to the risk of helical buckling and subsequent lock-up of the string.

Furthermore, if the borehole includes a horizontal section, a compressive load exerted to the drill string at surface will mainly result in the drill string being laterally pressed against the borehole wall in the horizontal section. Therefore, in the absence of measures taken to overcome these problems, the maximum available Weight On Bit during coiled tubing drilling is unacceptably limited, and horizontal borehole sections can only be drilled to a short length.

International patent application WO 93/24728 discloses a downhole tool for providing a thrust force to an elongate body extending in a borehole formed in an earth formation, the tool comprising at least one rotatable body provided with a plurality of rollers, each roller being expandable against the borehole wall at a selected contact force between the roller and the borehole wall, the rollers being oriented when expanded against the borehole wall so as to roll along a helical path on the borehole wall, and a motor to rotate each rotatable body.

When the rollers of the known tool are expanded against the borehole wall and the motor rotates the rotatable body, the tool has a tendency to move the elongate body forward through the borehole due to the helical path followed by the rollers. By the tendency to move forward the tool exerts a thrust force to the elongate body, which thrust force corresponds to the resistance encountered by the elongate body. When the thrust force is relatively high due to a high resistance of the elongate body, the rollers will slip along the borehole wall in circumferential direction thereof. It will be appreciated that by continued slippage of the rollers, the borehole wall becomes increasingly worn out so that the borehole diameter increases. Since the amount of radial expansion of the rollers is limited, continued slippage of the rollers leads to a vanishing contact force between the rollers and the borehole wall and thereby to a vanishing thrust force.

Furthermore, the rotative body of the known tool is directly connected to a drill bit provided at the elongate body, so that during operation the reactive torque from the drill bit is enhanced by the reactive torque from the rotative body.

SUMMARY OF THE INVENTION

It is an object of the invention to provide a downhole tool for providing a thrust force to an elongate body extending in a borehole formed in an earth formation, which tool overcomes the problems of the known tool.

It is another object of the invention to provide a downhole tool for providing a thrust force to an elongate body in the form of a drilling assembly extending in a borehole formed in an earth formation, which tool alleviates the reactive torque from the drill bit located at the lower end of the drilling assembly.

According to one aspect of the invention there is provided a downhole tool for providing a thrust force to an elongate body extending in a borehole formed in an earth formation, the tool comprising at least one rotatable body provided with a plurality of rollers, each roller being expandable against the borehole wall at a selected contact force between the roller and the borehole wall, the rollers being oriented when expanded against the borehole wall so as to roll along a helical path on the borehole wall, and a motor to rotate each rotatable body, wherein the tool further comprises measuring means to measure the thrust force provided by the tool and a control system to control the thrust force provided by the tool by regulating the rotative torque of the rotatable body, in response to the measured thrust force.

By regulating the rotative torque in response to the measured thrust force, the amount of slippage of the rollers can be controlled since such slippage depends on the rotative torque of the rotatable body. When, for example, the elongate body includes a drill string and the drilling progress is hampered due to a hard rock formation encountered by the drill bit, the resistance to the drill bit tends to increase and thus the thrust force provided by the tool tends to increase. The control system will then decrease the rotative torque so that the amount of slippage decreases thereby effectively preventing the borehole wall becoming worn out.

According to another aspect of the invention there is provided a downhole tool for providing a thrust force to a drilling assembly extending in a borehole formed in an earth formation, the tool comprising at least one rotatable body provided with a plurality of rollers, each roller being expandable against the borehole wall at a selected contact force between the roller and the borehole wall, the rollers being oriented when expanded against the borehole wall so as to roll along a helical path on the borehole wall, and a motor to rotate each rotatable body, wherein the direction of rotation of the rotatable body is opposite to the direction of rotation of the drill bit located at the lower end of the drilling assembly.

By the drill bit and the rotatable body having opposite directions of rotation, the reactive torque from the drill bit is partly or wholly compensated by the reactive torque from the rotatable body, thus enabling the application of relatively small diameter drill string, for example coiled tubing, to be applied.

The downhole tool of the invention can be used for various applications, for example for pushing tools through the borehole, or for drilling of the borehole. The tool is specifically attractive for extended reach drilling where extremely long boreholes are to be drilled, such as required for the exploitation of some offshore oil/gas fields.

DESCRIPTION OF THE DRAWINGS

The invention will be described hereinafter in more detail and by way of example with reference to the accompanying drawing in which FIG. 1 schematically shows an embodiment of the downhole tool according to the invention.

DESCRIPTION OF THE PREFERRED EMBODIMENTS

Figure 1:
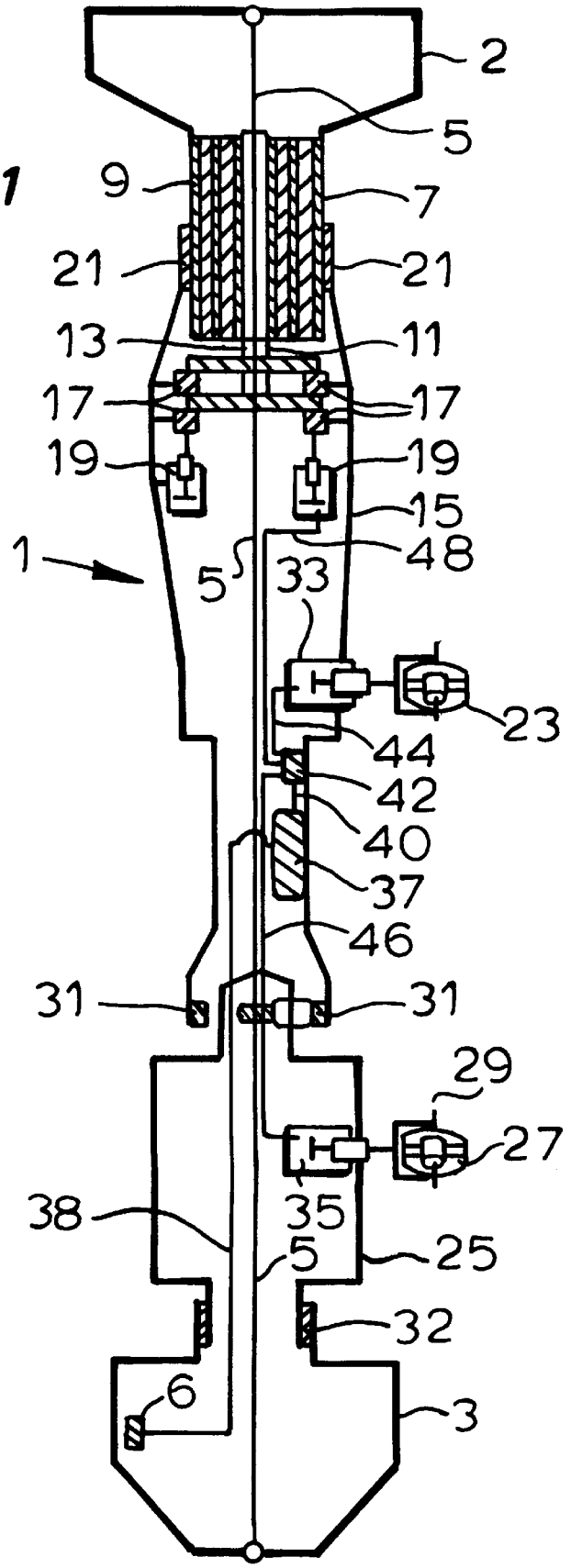

Referring to FIG. 1, the downhole tool 1 according to the invention includes an upper connector 2 for connecting the tool 1 to an upper part of a drilling assembly (not shown), and a lower connector 3 for connecting the tool 1 to a lower part of the drilling assembly. The connectors 1, 3 are interconnected by means of a central shaft 5 so as to transmit from the lower connector 3, via the shaft 5, to the upper connector 2, or vice versa. A thrust force measurement gauge 6 is located in the lower connector 3, which gauge 6 in operation thereof provides an electric signal representative of the thrust force provided by the downhole tool 1 to the lower part of the drilling assembly. In the schematic representation of FIG. 1 the shaft 5 is indicated as a single element, however in practice the shaft 5 suitably consists of a number of interconnected shaft sections. The tool 1 is provided with a Moineau motor 7 having a stator 9 fixedly attached to the upper connector and a rotor 11 which has a longitudinal bore 13 through which the central shaft 5 extends. The rotor 11 of the Moineau motor 7 drives a first rotatable body 15 via a clutch assembly 17 which is operated by means of a hydraulic piston/cylinder assembly 19. A bearing 21 is provided between the first rotatable body 15 and the stator 9 of the Moineau motor 7 to allow rotation of the body 15 relative to the stator 9 of the motor 7. The first rotatable body 15 is provided with a set of rollers 23 of which only roller is shown for the sake of clarity. Each roller 23 has an axis of rotation 25 which is inclined relative to the longitudinal axis of the rotatable body 15 so that, when the tool 1 is located in a borehole formed in an earth formation and the rollers 23 are in contact with the borehole wall, the rollers 23 follow a helical path along the borehole wall when the first rotatable body 15 rotates.

The tool 1 further comprises a second rotatable body 25 provided with a set of rollers 27 of which only roller is shown for the sake of clarity. Similarly to the rollers 23 of the first rotatable body 15, each roller 27 has an axis of rotation 29 which is inclined relative to the longitudinal axis of the rotatable body 25 so that, when the tool 1 is located in a borehole formed in an earth formation and the rollers 27 are in contact with the borehole wall, the rollers 27 follow a helical path along the borehole wall when the second rotatable body 25 rotates. The second rotatable body 25 is rotatably driven by the first rotatable body 15 via a gear assembly 31 which is only schematically indicated in the Figures. The gear assembly 31 has three switching positions, whereby in the first switching position the second rotatable body 25 has the same rotational speed as the first rotatable body 15, in the second switching position the second rotatable body 25 has a higher rotational speed than the first rotatable body 15, and in the third switching position the second rotatable body 25 rotates at the same speed as in the second switching position but in reverse direction. The gear assembly 31 is electrically controlled so as to be switched between the three switching positions via a conductor (not shown) extending along the drilling assembly to suitable control equipment at surface. A bearing 32 is provided between the second rotatable body 25 and the lower connector 3 so as to rotatably support the body 25 relative to the connector 3.

Each roller 23, 27 is expandable in radial direction so as to be pressed against the borehole wall, by means of a hydraulic piston/cylinder assembly 33, 35 which is capable of moving the axis of rotation 25, 29 of the roller 23, 27 in radial direction of the rotatable body 15, 25. The piston/cylinder assemblies 33 pertaining to the rollers 23 of the first rotatable body 15 are operable independently from the piston/cylinder assemblies 35 pertaining to the rollers 27 of the second rotatable body 25.

An electronic control system 37 is arranged in the tool 1, which control system 37 is provided with a setting for the thrust force which is to be delivered by the tool 1 when in operation, which setting can be varied by an operator at surface by means of a control system (not shown) electrically connected to the control system 37 via a conductor (not shown) extending along the drilling assembly. The control system 37 receives an input signal from the thrust force measurement gauge 6 via a wire 38, which input signal represents the thrust force provided by the tool 1 to the drilling assembly in which the tool is incorporated. The control system 37 is connected, via a wire 40, to a hydraulic power source 42. The piston/cylinder assemblies 33, 35 pertaining to the rollers 23, 27 are hydraulically connected to the power source 42 via control lines 44, 46, and the piston/cylinder assembly 19 pertaining to the clutch assembly 17 is hydraulically connected to the power source 42 via control line 48. A valve system (not shown) is provided in the tool 1 to selectively open or close the hydraulic connections between the power source 42 and each piston/cylinder assembly 19, 33, 35 which valve system is electrically controlled at surface via a conductor (not shown) extending along the drilling assembly. Thus, by controlling the valve system, the piston/cylinder assemblies 19, 33, 35 can be operated in a mutually independent manner. The control system 37 is programmed so as to induce the power source 42 to operate the piston/cylinder assemblies 19, 33, 35 in a manner that deviations of the thrust force from the thrust force setting are minimized.

During normal operation, the downhole tool 1 is incorporated in the lower section of a drilling assembly extending in a borehole which is being drilled in an earth formation. The upper connector 2 is connected to an upper part of the drilling assembly, and the lower connector is connected to a lower part of the drilling assembly. Said upper part of the drilling assembly is significantly longer than the lower part of the drilling assembly, which lower part only includes a downhole drilling motor driving a drill bit and one or more stabilizers. Optionally the lower part of the drilling assembly can also include one or more heavy weight drill pipe sections. When a selected thrust force is desired in order to maintain Weight On Bit (WOB), the desired thrust force setting is programmed in the control system, and the valve system is operated so that the piston/cylinder assemblies 33 of the first rotatable body become hydraulically connected to the power source 42.

The motor 7 is operated and the clutch assembly 17 is engaged so that the motor 7 drives the first rotatable body 15. The control system 37 receives an input signal representing the actual thrust force from gauge 6, compares this signal with the thrust force setting, and induces the power source 42 to operate the piston/cylinder assemblies 33 so as to expand the rollers 23 against the borehole wall. The degree of expansion corresponds to the contact force between each roller 23 and the borehole wall, which is required to minimize a difference between the actual thrust force and the thrust force setting. As the rollers 23 are pressed against the borehole wall, the rollers 23 roll along a helical path on the borehole due to rotation of the first rotatable body 15 thereby inducing an axial thrust force to the tool 1, which thrust force acts in the direction of the drill bit at the lower end of the drilling assembly.

When the actual thrust force is lower than the thrust force setting, the control system 37 induces the power source 42 to operate the piston/cylinder assemblies 33 so as to increase the contact force at which the rollers 23 are expanded against the borehole wall.

Conversely, when the actual thrust force is higher than the thrust force setting, the control system 37 induces the power source 42 to operate the piston/cylinder assemblies 33 so as to decrease the contact force at which the rollers 23 are expanded against the borehole wall.

Instead of, or in addition to, the control system 37 inducing the power source 42 to operate the piston/cylinder assemblies 33, the control system 37 can induce the power source 42 to operate the piston/cylinder assembly 19 of the clutch assembly 17 so as to allow slippage of the clutch assembly 17 when the actual thrust force is to be reduced.

When the thrust force setting is higher than the thrust force which can be achieved by the rotatable body 15, the gear assembly 31 is switched by an operator at surface to its first switching position in which the first rotatable body 15 and the second rotatable bodies 25 rotate at the same speed. Furthermore the valve system is positioned so as to hydraulically connect the piston/cylinder assemblies 35 to the power source 42. The control system 37 then induces the power source 42 to operate the piston/cylinder assemblies 35 so as to expand the rollers 27 of the second rotatable body against the borehole wall. Thus the actual thrust force is enhanced due to the additional thrust force provided by the second rotatable body 25.

In an alternative mode of operation of the downhole tool 1, the valve system is adjusted so that the piston/cylinder assemblies 33 of the rollers 23 are not operated, while the piston/cylinder assemblies 35 of the rollers 27 are operated so as to press the rollers 27 against the borehole wall. The gear assembly 31 is switched to its second switching position in which the second rotatable body 25 rotates at a higher speed than the first rotatable body 15. In this mode the tool is used to move the drilling assembly through the borehole during tripping in downward direction.

In another alternative mode of operation of the downhole tool 1, the valve system is adjusted so that the piston/cylinder assemblies 33 of the rollers 23 are not operated, while the piston/cylinder assemblies 35 of the rollers 27 are operated so as to press the rollers 27 against the borehole wall. The gear assembly 31 is switched to its third switching position in which the second rotatable body 25 rotates at a relatively high speed in reverse direction. In this mode the tool is used to move the drilling assembly through the borehole during tripping in upward direction.

Instead of, or in addition to, controlling the actual thrust force provided by the tool 1 by controlling the contact force between the rollers 23, 27 and the borehole wall, the control system 37 can be programmed to control the actual thrust force by controlling the amount of slippage of the clutch assembly 17 so as to minimize a difference between the actual thrust force and the thrust force setting. In case the actual thrust force is only controlled by the amount of slippage of the clutch assembly 17, the contact forces between the rollers 23, 27 and the borehole wall remain constant.

Furthermore, instead of, or in addition to, applying the clutch assembly described above, the tool can alternatively be provided with an energy supply regulator which regulates the amount of energy provided to the motor to regulate the torque of the motor. The energy supply regulator is controlled by the control system, and can be in the form of a controllable hydraulic bypass for the above described Moineau motor. If an electric motor is used instead of a Moineau motor, the energy supply regulator can take the form of an electric current regulator controlled by the control system of the tool.

In the above described embodiment the Moineau motor has an inner longitudinal shaft serving as the rotor and an outer cylindrical housing serving as the stator, whereby the rotor has a longitudinal bore through which the central shaft interconnecting the upper and the lower connector extends. In an alternative arrangement a reversed Moineau motor can be applied, which reversed Moineau motor has an inner longitudinal shaft serving as the stator and an outer cylindrical housing serving as the rotor. The inner shaft then forms part of the central shaft interconnecting the upper connector and the lower connector, and the cylindrical housing then drives each cylindrical body via the clutch assembly. Furthermore, instead of the gear assembly described with reference to FIG. 1, which has three switching positions, whereby in the second switching position the second rotatable body has a higher rotational speed than the first rotatable body, a gear assembly can be applied which has no switching positions but which continuously drives the second rotatable body at said higher rotational speed. Switching between moving the tool through the borehole at a low and a high speed is then achieved by selectively expanding the rollers of the first rotatable body or the rollers of the second rotatable body against the borehole wall.

It will be appreciated that the above described downhole tool can be applied in combination with any suitable drilling assembly, for example an assembly including one or more of the following components: a steering tool for steerable drilling, a measurement while drilling device, and a coiled tubing.

What is claimed is:

1. A downhole tool for providing a thrust force to an elongate body extending in a borehole formed in an earth formation, the tool comprising at least one rotatable body provided with a plurality of rollers, each roller being expandable against the borehole wall at a selected contact force between the roller and the borehole wall, the rollers being oriented when expanded against the borehole wall so as to roll along a helical path on the borehole wall, and a motor to rotate each rotatable body, wherein the tool further comprises measuring means to measure the thrust force provided by the tool and a control system to control the thrust force provided by the tool by regulating the rotative torque of the rotatable body, in response to the measured thrust force.

2. The downhole tool of claim 1, wherein the control system regulates said torque by regulating said selected contact force between each roller and the borehole wall.

3. The downhole tool of claim 2, wherein the axis of rotation of each roller is expandable in radial direction so as to press the roller against the borehole wall, whereby said contact force is regulated by regulating the radial expansion of the axis of rotation of the roller.

4. The downhole tool of claim 1, wherein the control system regulates the torque required to rotate the rotatable body by regulating the torque provided by the motor to the rotatable body.

5. The downhole tool of claim 4, further comprising a clutch assembly for transmitting the torque from the motor to the rotatable body, wherein the control system regulates the torque required to rotate the rotatable body by regulating the amount of slip of the clutch assembly.

6. The downhole tool of claim 4, further comprising an energy supply regulator which regulates the amount of energy provided to the motor, wherein the control system regulates the torque required to rotate the rotatable body by regulating the amount of energy supplied to the motor by the energy supply regulator.

7. The downhole tool of claim 1, further comprising switching means to switch between a first mode of operation of the tool and a second mode of operation of the tool, wherein in the first mode of operation the tool moves through the borehole at a lower speed than in the second mode of operation.

8. The downhole tool of claim 7, wherein said switching means includes a gear box to switch between a first rotational speed of the rotatable body and a second rotational speed of the rotatable body, the first rotational speed being lower than the second rotational speed.

9. The downhole tool of claim 7, wherein the tool comprises a first and a second of said rotatable bodies, said switching means including a gear box to switch between rotation of the first rotatable body and rotation of the second rotatable body, the rotational speed of the first rotatable body being lower than the rotational speed of the second rotatable body.

10. The downhole tool of claim 1, wherein said motor forms one of the group of: a Moineau motor having a stator in the form of the housing of the motor and an inner rotor, a reversed Moineau motor having a inner stator and a rotor in the form of the housing of the motor, a vane motor, a turbine, and an electric motor.

11. The downhole tool of claim 1, wherein the elongate body includes a drilling assembly extending from the earth surface into the borehole, the drilling assembly having a drill bit arranged at the lower end thereof.

12. The downhole tool of claim 11, wherein the direction of rotation of the rotatable body is opposite to the direction of rotation of the drill bit.

13. The downhole tool of claim 1, wherein the elongate body includes a coiled tubing extending from the earth surface into the borehole, the downhole tool being connected to the lower end of the coiled tubing.

14. A downhole tool for providing a thrust force to a drilling assembly extending in a borehole formed in an earth formation, the tool comprising at least one rotatable body provided with a plurality of rollers, each roller being expandable against the borehole wall at a selected contact force between the roller and the borehole wall, the rollers being oriented when expanded against the borehole wall so as to roll along a helical path on the borehole wall, and a motor to rotate each rotatable body, wherein the direction of rotation of the rotatable body is opposite to the direction of rotation of a drill bit located at the lower end of the drilling assembly.

15. The downhole tool of claim 14, wherein the drilling assembly includes a coiled tubing extending from the earth surface into the borehole, the downhole tool being connected to the lower end of the coiled tubing.

* * * * *